US005653353A

United States Patent [19]

Otto et al.

[11] Patent Number: 5,653,353

[45] Date of Patent: Aug. 5, 1997

[54] UNITARY CAP AND COLLAR WITH INTEGRAL TETHER CONSTRUCTION FOR BOTTLE FEEDER

[76] Inventors: Robin G. Otto; Jeffrey Otto, both of 411 S. Ivy La., Glen Mills, Pa. 19342

[21] Appl. No.: 511,657

[22] Filed: Aug. 7, 1995

[51] Int. Cl.[6] ..... A61J 9/08; B65D 55/16

[52] U.S. Cl. ..... 215/306; 215/11.6

[58] Field of Search ..... 215/306, 11.6, 215/258, 11.1; 220/717, 375

[56] References Cited

U.S. PATENT DOCUMENTS

| | | | |
|---|---|---|---|
| 524,159 | 8/1894 | Birnbaum | 215/306 X |
| 715,399 | 12/1902 | Low | 215/306 |
| 1,662,189 | 3/1928 | Hyatt | 220/375 |
| 2,483,870 | 10/1949 | Bailey | 215/11 |
| 3,235,117 | 2/1966 | Mason, Jr. | 215/306 X |
| 3,273,703 | 9/1966 | Stribley | 206/46 |
| 3,332,564 | 7/1967 | Melerhofer | 215/11 |
| 3,416,688 | 12/1968 | Fanning | 215/41 |
| 3,490,177 | 1/1970 | Perrion | 49/463 |
| 3,874,570 | 4/1975 | Katzman et al. | 222/543 |
| 4,036,357 | 7/1977 | Czelen | 220/375 X |
| 4,192,307 | 3/1980 | Baer | 128/252 |
| 4,203,524 | 5/1980 | Wieland | 215/216 |
| 4,432,120 | 2/1984 | Sherman, Jr. et al. | 24/299 |
| 4,526,289 | 7/1985 | Schenmann | 220/304 |
| 4,595,130 | 6/1986 | Berney | 222/543 |
| 4,669,641 | 6/1987 | Holmes | 222/543 |
| 4,700,856 | 10/1987 | Campbell et al. | 215/11 E |
| 4,753,358 | 6/1988 | Virca et al. | 215/230 |
| 4,817,450 | 4/1989 | Jachiim | 73/866.5 |
| 5,044,512 | 9/1991 | Giancaspro et al. | 215/306 X |
| 5,154,327 | 10/1992 | Long | 22/375 X |
| 5,180,071 | 1/1993 | Crosson | 215/11.6 X |
| 5,207,657 | 5/1993 | Gibilisco | 215/306 X |
| 5,361,918 | 11/1994 | Mason | 215/11.6 X |

*Primary Examiner*—Allan N. Shoap
*Assistant Examiner*—Niki M. Kopsidas
*Attorney, Agent, or Firm*—Eugene E. Renz, Jr.

[57] ABSTRACT

A unitary cap and collar construction for a bottle feeder having a nipple cap secured to a detachable collar which comprises a nipple, a single, flexible, integral tether line of sufficient length for an infant to feed from the nipple having one end engaged to a detachable collar having an opening for holding the feeder nipple which the collar is detachably connected to the bottle, and having an opposite end engaged to the cap for covering the nipple.

4 Claims, 2 Drawing Sheets

UNITARY CAP AND COLLAR WITH INTEGRAL TETHER CONSTRUCTION FOR BOTTLE FEEDER

FIELD OF THE INVENTION

This invention relates to the unitary construction of a keeper device for preventing the protective cap which covers the nipple of a baby's nursing bottle from becoming separated from the collar that holds the nipple even when the cap is detached from the bottle.

BACKGROUND OF THE INVENTION

In a mobile society such as ours, many parents and other care providers to infants and young toddlers frequently lose or misplace the protective caps for baby feeding bottles. This problem is encountered frequently in day care situations where only one care provider is responsible for several small children. It seems small children also enjoy picking up the loose unattached protective bottle covers and playing with them until they lose their interest; the cap is then thrown away and/or lost.

The absence of a protective cap on the bottle can increase the likelihood of disease because airborne viruses and communicable diseases can be transferred when another child puts either the exposed nipple and bottle assembly or the unattached protective cover in his mouth.

In addition, it is very expensive to constantly replace the cap, and a nuisance not to have a cap when you need one.

There are teachings of providing a tether to connect a closure cap to a container; some of which permit free swiveling of the cap when it is fastened to the container. Concern has been focused on keeping a closure cap connected to the container it closes off so that when the cap is removed it will hang next to its container. Illustrative of devices used to retain caps on containers are chains attached to a fuel tank cap and to a mounting block which can be adhesively secured to an automobile; such a device is shown in Sherman, et al U.S. Pat. No. 4,432,120. The device connects the cap to a stationary surface utilizing an adhesive bonding material; this cap is not reusable nor transferable, and it is attached to a base member.

In Katzman, et al U.S. Pat. No. 3,874,570, a closure cap is attached by a flexible strap to a container which is a dispensing tube of toothpaste. The strap is fixed to the tube and rotatably attached to the closure cap by means of a ball at one end of the strap that fits into a circumferential groove on the cap.

Another example of a tethered cap that can swivel or rotate freely when connected to a container for dispensing fluids is Holmes U.S. Pat. No. 4,669,641. Again, the cap is of the closure-type and it is connected directly to the permanent body of the container. The concept of this patent and the prior art is to fixedly secure one end of the tether to a base member and then to jury rig some way to rotate the closure cap freely in reconnecting it to the base member or container without fouling the tether means. This type of assembly lacks a flexible, speedy, economical method for reusing the cap member of the assembly.

The above concept of strapping a closure cap in rotatable connection with a base member container for dispensing fluids is shown in Berney U.S. Pat. No. 4,595,130 which discloses the use of a tether having a loop at each end which fits inside of annular grooves on the top of a closure cap and around the base of the pouring neck of the container.

SUMMARY OF THE INVENTION

The product of this invention is a unitary construction which comprises a single, flexible, integral tether line means having one end engaged in a cap means for protecting the nipple of a bottle feeder and an opposite end engaged in a collar means for mounting said nipple inside said bottle which is screw-threadably engageable to the bottle or snapped on to the bottle.

It is an object of this invention to provide a detachable construction assembly of a protective cap connected by tether means to a detachable collar having a nipple inserted through it for use in a baby bottle feeder which can be removed from the bottle. In the prior art, the closure caps were tethered to the base member container which prevented the removal of the cap from the container. In this invention, the entire detachable collar-nipple-protective cap assembly may be removed from the bottle because the cap is not tethered to the bottle, but instead, it is fastened to the detachable collar. This then permits the washing of the bottle as a singular unit without the attachment of any extra objects that may become entangled with other objects during washing.

BRIEF DESCRIPTION OF THE DRAWINGS

These and other objects of the present invention and the various features and details of the operation and construction thereof are hereinafter more fully set forth with reference to the accompanying drawings, where.

Figures 1, 2:
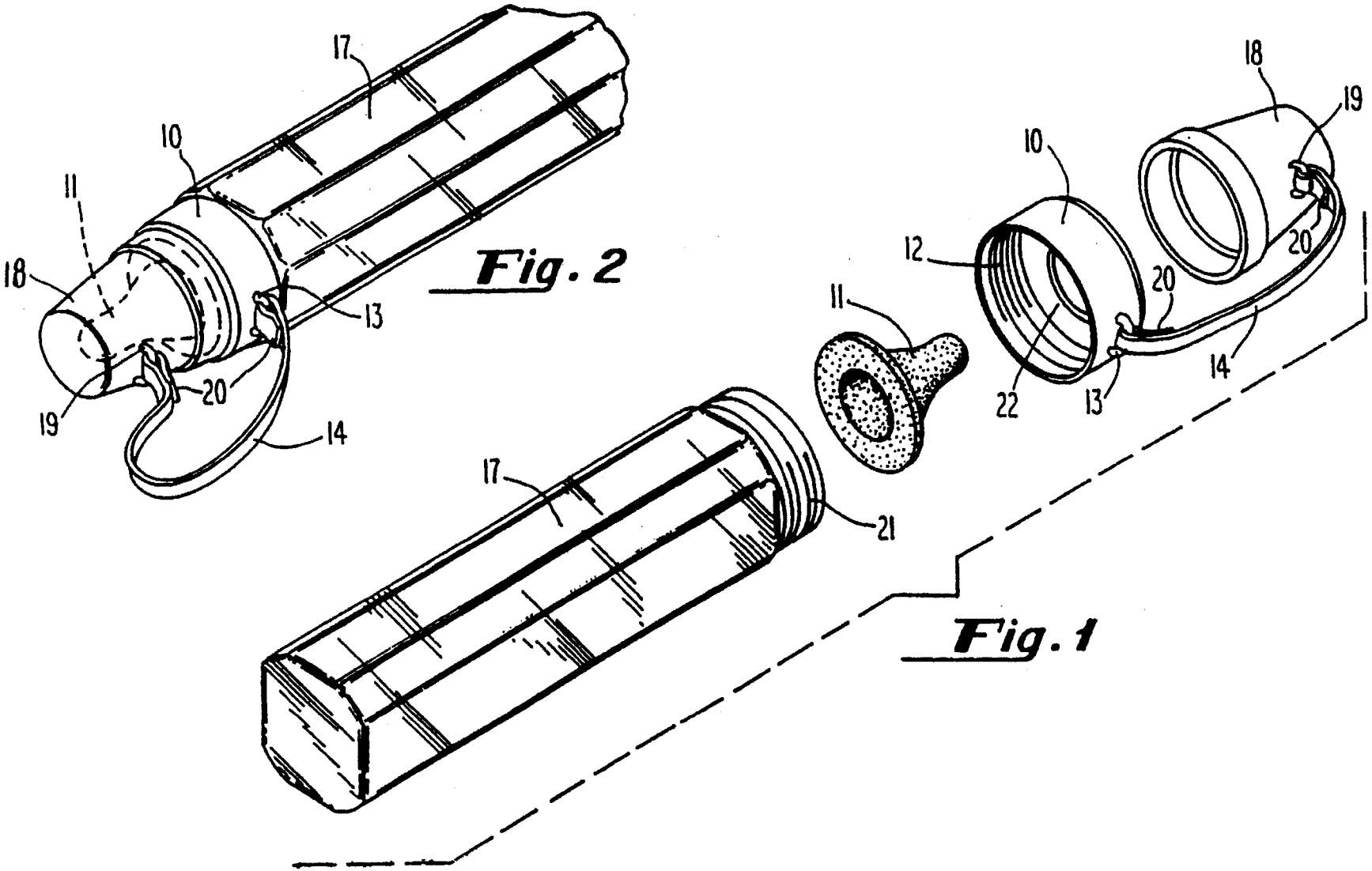
FIG. 1 is a perspective view of the unitary bottle feeder construction comprising the detachable collar having an integral tether eyelet member containing the nipple shown in detail in position to be placed inside the detachable collar, the single tether line means, and the protective cap having an integral tether eyelet member which is detached from the collar.
FIG. 2 is a perspective view of the entire bottle feeder assembly with the cap snapped onto the collar with a nipple shown in phantom outline inside the cap and with the collar screwed into threaded engagement with the bottle.
Figure 3:
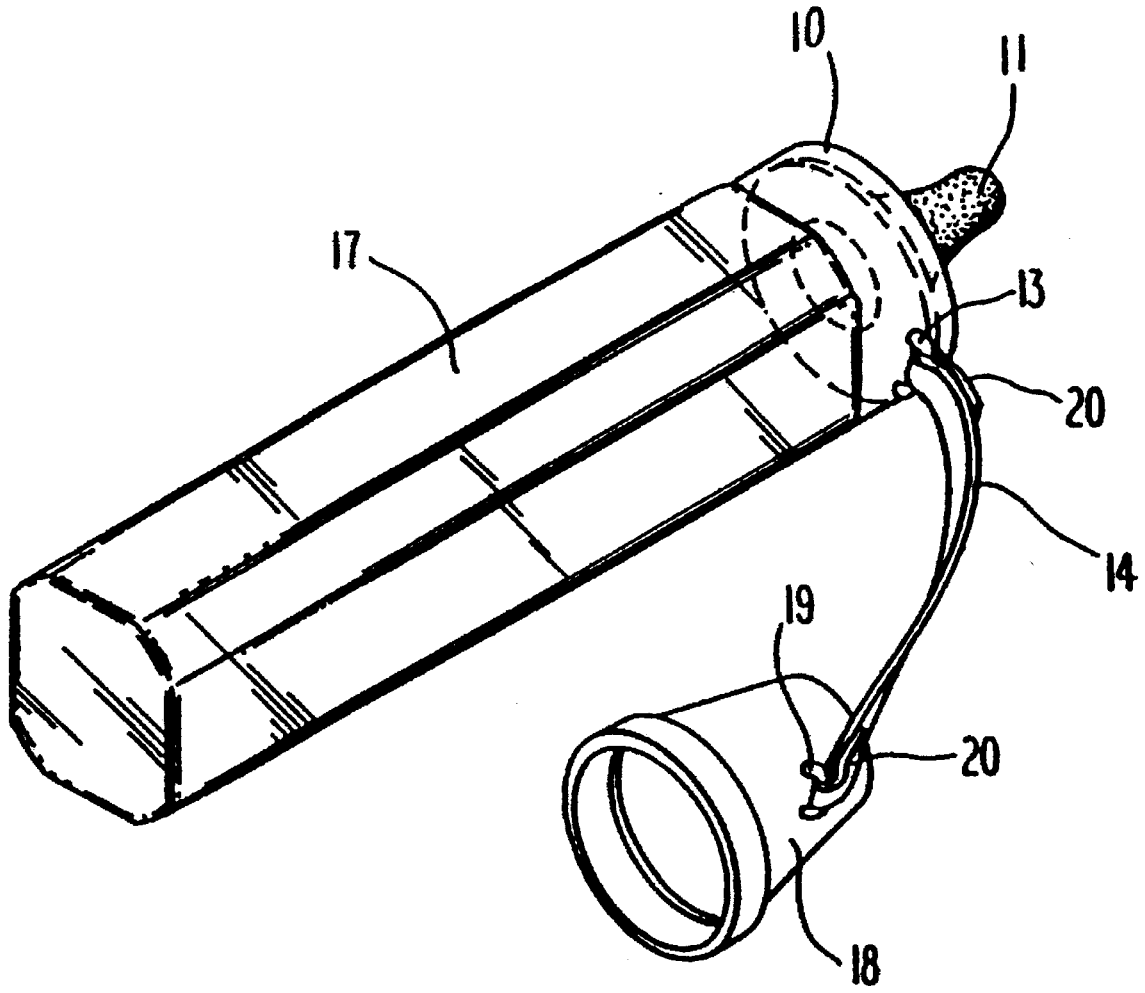
FIG. 3 is a perspective view of the above assembly with the top keeper cap detached from the collar containing the nipple to the bottle assembly inside the collar which is screwed into threaded engagement with the bottle, but the cap is not attached to the bottle assembly is an engaged relationship, instead it is connected to the collar by tether line means.

The detachable collar of this invention 10 has a nipple 11 inserted through it for dispensing milk for formula. The collar 10 comprises a standard screw thread 12 on the inside to hold it onto the standard screw thread neck 21 of an ordinary baby bottle, and it also comprises an eyelet member 13 on its circumferential outer surface to engage the one end of the single tether line 14. Any standard nipple 11 can be used in this invention in combination with any standard baby bottle 17.

The protective cap 18 comprises an eyelet member 19 on its outer surface which may be located either on the top outer surface of the cap, or its circumferential outer surface. The tether ends 20 may be secured through the eyelet members of the cap 19 and collar 13 by any conventional means, such as doubling the end back upon the body strand of the tether line by sewing the end and body strand together, or by bonding together with an adhesive material, or by the use of a velcro-type eyelet and hook material for the construction of the tether line.

The single tether line means 14 is permanently connected at one end to the eyelet member 19 or the cap, and at the other end to the eyelet member 13 of the detachable collar; the nipple is inserted by its tip first through the open base 22 of the collar in a standard manner; the collar which contains the nipple is then screwed onto the standard screw neck of a baby bottle.

DETAILED DESCRIPTION OF THE PREFERRED EMBODIMENT

The product of this invention is an integrated unitary construction assembly having an integral tether means which connects the collar 10 with the protective cap keeper 18 which tethered sub-assembly is interchangeable with different containers or bottles since it is fitted with standard collar and thread sizes and standard nipple sizes and standard protective cover sizes. The cap keeper may be a standard snap on cap which covers an upper portion of only the nipple, or it may be enlarged so that it also covers an upper portion of the outer surface of the detachable collar.

The tether 14 material may be formed out of non-toxic synthetic or natural material such as a flexible plastic or a flexible textile material. The eyelet members of the cap and collar may be formed of polymer or plastic material by any suitable molding process. The tether line is of sufficient length so as not to interfere with feeding the baby.

There are several advantages obtained from the product of this invention. A significant advantage is the ability to reuse the protective cap keeper and cover assembly interchangeably on any standard screw-threadably engageable bottle or base container. There is also better hygiene because the cap is always attached to the collar-nipple-bottle assembly which makes it more likely that the nipple will be covered by the protective cap keeper when the bottle is not in use for feeding a baby. It is safer assembly because the cap cannot be swallowed by the baby since it is connected by tether means to the collar which is engaged onto the bottle. As a result of the bottle nipple being covered by the tethered cap, its exposure to airborne viruses is reduced, and, in day care situations, it reduces the chances of another child putting the exposed contaminated nipple in his mouth and either becoming infected or spreading germs.

Another significant advantage of the product of this invention is the convenience of always having a protective cap for the bottle. This invention eliminates the nuisance of misplaced or lost caps; it also provides an economical advantage because it is less likely that the tether-attached cap and collar assembly will be lost or damaged as readily as a conventional unconnected cap or collar. This invention comprises a safer assembly than the prior art because the cap keeper means cannot be swallowed by the baby since it is connected by tether means to the collar which is engaged onto the bottle. The assembly is more sanitary since it is not exposed to airborne germs.

There is an additional advantage for the baby in that the aforesaid assembly can serve as a toy which aids in nutritional intake during bottle feedings. It takes approximately 20 minutes for an infant to drink milk or formula from a bottle, and during that time many infants, especially premature and ill babies, can become bored and lose interest in the bottle and fall asleep. The tether means and free swinging cap keeper can become a toy which keeps the child's interest during feeding.

It is understood that the above narrative description and examples are illustrative only of the preferred embodiments of this invention. Certain modifications may be made which come within the scope of the disclosure of the inventive concept. This invention is defined further by the claims hereinbelow and their legal equivalent.

What is claimed is:

1. The combination comprising;

a collar for detachably mounting a nipple on a bottle or container having a circumferentially extending sidewall;

a first bracket formed integrally with the collar and mounted on a circumferentially extending sidewall of the collar;

a second bracket for detachably securing the cap to the collar in a position overlying the nipple and being of generally C-shaped configuration comprising two spaced legs integrally molded to the cap separated by a bight;

a tether made of a non-toxic pliant strip of material and pivotally mounted at its opposite end to the second bracket in a manner to provide free swinging movement of the cap relative to the collar when the cap is detached from the collar to provide interactive toy like play value for an infant during feeding.

2. The combination as claimed in claim 1, wherein said first bracket is C-shaped.

3. The combination as claimed in claim 1, wherein said first bracket is mounted on the circumferentially extending sidewall of said collar and said second bracket is mounted on the peripheral wall of said cap depending from the top.

4. The combination as claimed in claim 1, wherein said collar is threadedly attached to said bottle.

* * * * *